US006615744B1

(12) United States Patent
Eckstein et al.

(10) Patent No.: US 6,615,744 B1
(45) Date of Patent: Sep. 9, 2003

(54) OVERBED TABLE

(75) Inventors: Gerald D. Eckstein, Batesville, IN (US); Christopher M. George, Cincinnati, OH (US); Raymond C. Gould, Greensburg, IN (US); David W. Hornbach, Brookville, IN (US); Ken Q. Rudolph, Batesville, IN (US); Michelle Walker, Cincinnati, OH (US); Robert Mark Zerhusen, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/835,002

(22) Filed: Apr. 13, 2001

Related U.S. Application Data

(60) Provisional application No. 60/251,950, filed on Dec. 7, 2000.

(51) Int. Cl.[7] ..... A47B 9/20

(52) U.S. Cl. ..... 108/147.2; 108/140; 108/141; 108/143; 108/49

(58) Field of Search ..... 108/147, 146, 108/147.2, 145, 147.11, 5, 49, 137, 42, 143, 139, 140, 141, 142

(56) References Cited

U.S. PATENT DOCUMENTS

| | | | | |
|---|---|---|---|---|
| 1,232,757 | A | * | 7/1917 | Berkey |
| 1,653,657 | A | * | 12/1927 | Pretsch |
| 1,775,877 | A | * | 9/1930 | Waples |
| 1,888,124 | A | * | 11/1932 | Pulaski |
| D132,427 | S | | 5/1942 | Hillenbrand |
| D134,456 | S | | 12/1942 | Hillenbrand |
| D135,341 | S | | 3/1943 | Hillenbrand |
| D135,507 | S | | 4/1943 | Hillenbrand |
| 2,321,204 | A | | 6/1943 | Hillenbrand |
| 2,329,902 | A | | 9/1943 | Hillenbrand |
| 2,342,631 | A | | 2/1944 | Hillenbrand |
| 2,346,919 | A | | 4/1944 | Hillenbrand |
| 2,352,837 | A | | 7/1944 | Hillenbrand |
| 2,357,588 | A | | 9/1944 | Hillenbrand |
| D149,793 | S | | 6/1948 | Burst |
| 2,456,415 | A | | 12/1948 | Hillenbrand |
| 2,580,032 | A | * | 12/1951 | Lindelof |
| 3,854,428 | A | | 12/1974 | Fullenkamp |
| 4,667,605 | A | * | 5/1987 | Bastian |
| 4,715,295 | A | | 12/1987 | Hartman et al. |
| 5,144,898 | A | * | 9/1992 | Posly |
| 5,337,682 | A | * | 8/1994 | Wiseman |
| 5,408,940 | A | * | 4/1995 | Winchell |
| 5,473,997 | A | | 12/1995 | Solomon et al. |
| 5,562,049 | A | * | 10/1996 | Hoffman et al. |
| 5,606,917 | A | * | 3/1997 | Cauffiel |

OTHER PUBLICATIONS 8 page brochure, undated picturing various over bed tables and related products.

"Anti–Creep System (ACS) The Key to Eliminating Cage Creep," SKF Motion Technologies Brochure, 2 pages, date unknown.

* cited by examiner

*Primary Examiner*—Jose V. Chen
(74) *Attorney, Agent, or Firm*—Barnes & Thornburg

(57) ABSTRACT

An overbed table includes a table portion and a telescoping support column. The column includes an outer column portion and an inner column portion. The inner and outer column portions have surfaces adjacent each other. A bearing cage is oriented between the adjacent surfaces of the inner and outer column portions. Bearings are captured between the surfaces and the bearing cage. The bearings engage the surfaces to promote projection of the inner column portion from, and retraction of the inner column portion into, the outer column portion. The overbed table also includes a first table section supported by the column for movement horizontally with respect to the column, and a second table section coupled to the first table section and the column such that movement of the second table section results in sliding movement of the first table section.

65 Claims, 6 Drawing Sheets

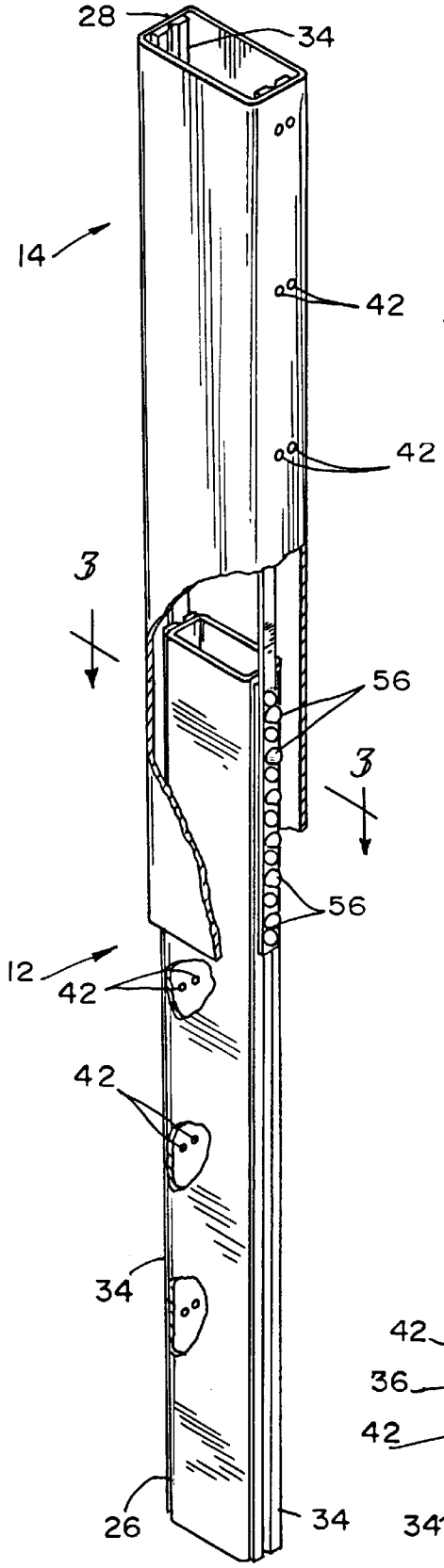
FIG 2
FIG. 3
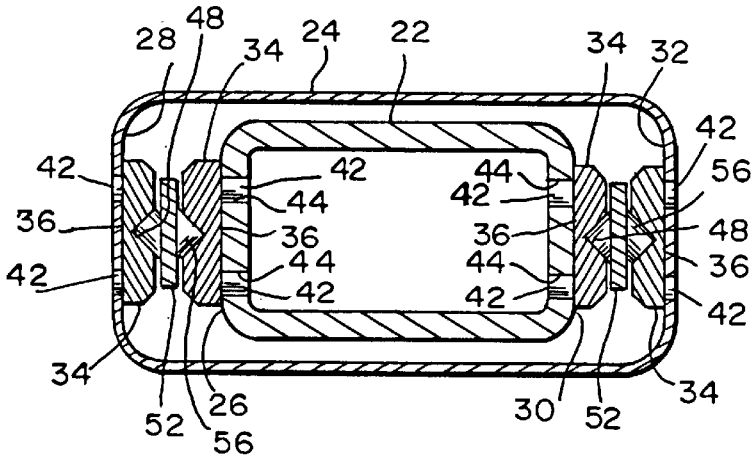

OVERBED TABLE

This application claims priority under 35 U.S.C. 119(e) to U.S. Provisional Application Serial No. 60/251,950, filed Dec. 7, 2000, which is expressly incorporated by reference herein.

FIELD OF THE INVENTION

This invention relates to overbed tables, and particularly, to overbed tables with telescoping columns and more than one table top.

BACKGROUND OF THE INVENTION

A number of different types of overbed tables are known. There are, for example, the overbed tables illustrated and described in U.S. Pat. Nos. 5,473,997, 4,715,295, and 3,854,428, the disclosures of which are hereby incorporated herein by reference. No representation is intended that a complete search has been made of the prior art or that no better art than that listed is available, and no such representation should be inferred. This listing shall not be construed to be an admission that the listed references are, or are considered to be, material to patentability.

DISCLOSURE OF THE INVENTION

According to one aspect of the invention, an overbed table includes a table portion and a telescoping support column. The column includes an outer column portion and an inner column portion. A table portion is coupled to one of the outer and inner column portions. A base is coupled to the other of the outer and inner column portions. The inner and outer column portions have surfaces adjacent each other. A bearing cage is oriented between the adjacent surfaces of the inner and outer column portions. Bearings are captured between the surfaces and the bearing cage. The bearings engage the surfaces to promote projection of the inner column portion from, and retraction of the inner column portion into, the outer column portion.

According to another aspect of the invention, an overbed table includes a frame, a first table section supported by the frame for movement horizontally with respect to the frame, and a second table section coupled to the first table section and the frame such that movement of the second table section results in sliding movement of the first table section.

Illustratively according to the invention, the first table section is further supported by the frame for movement between a generally vertical position and a generally horizontal position.

Further illustratively according to the invention, the second table section is releasably coupled to the first table section and the frame permitting movement of the first table section between a generally vertical position and a generally horizontal position independently of the second table section Additionally illustratively according to the invention, the first table section is supported by the frame by an inner member provided on one of the frame and first table section and an outer member provided on the other of the frame and first table section. The inner member extends rotatably and slidably through the outer member to permit movement sliding and pivoting movement of the first table section with respect to the frame.

Illustratively according to the invention, the surfaces include bearing races, the bearings captured between the races and within the cage.

Further illustratively according to the invention, the bearings include, roller bearings having axes of rotation. The axes of rotation of some of the bearings making non-zero angles with respect to the axes of rotation of others of the bearings.

Illustratively according to the invention, adjacent roller bearings are oriented with their axes of rotation at substantially 90 degree angles.

Additionally illustratively according to the invention, each of the inner and outer column portions includes two surfaces adjacent two surfaces of the other of the inner and outer column portions, and two bearing cages. One of the bearing cages is oriented between each pair of adjacent surfaces.

Illustratively according to the invention, the apparatus includes a brake for increasing the resistance of the outer and inner column portions to relative motion.

Further illustratively according to the invention, the brake includes a sheet of compressible material positioned between the surface and the column.

Illustratively according to the invention, the apparatus includes a pinion on one of a surface and the cage and a rack on the other of a surface and the cage. The pinion is mounted for rotation. The pinion engages the rack as the outer and inner column portions move relative to each other.

Further illustratively according to the invention, each of the surfaces includes a rack. The pinion engages both racks as the outer and inner column portions move relative to each other.

Illustratively according to the invention, each of the surfaces further includes a bearing race. The bearings are captured between the races and within the cage.

Illustratively according to the invention, each of the surfaces includes two bearing races spaced apart transversely of the directions of relative motion of the inner and outer column portions and a rack oriented between the two spaced apart bearing races.

Illustratively according to the invention, the telescoping column makes an angle between about zero degrees to about ten degrees to a perpendicular to a surface upon which the base rests.

BRIEF DESCRIPTION OF THE DRAWINGS

The invention may best be understood by referring to the following detailed description and accompanying drawings which illustrate the invention. In the drawings:

FIG. 2 illustrates a perspective phantom view of a telescoping column constructed according to the invention;

FIG. 3 illustrates a sectional view, taken generally along section lines 3—3, of the embodiment illustrated in FIG. 2;

DETAILED DESCRIPTION OF AN ILLUSTRATIVE EMBODIMENT

Figure 1:
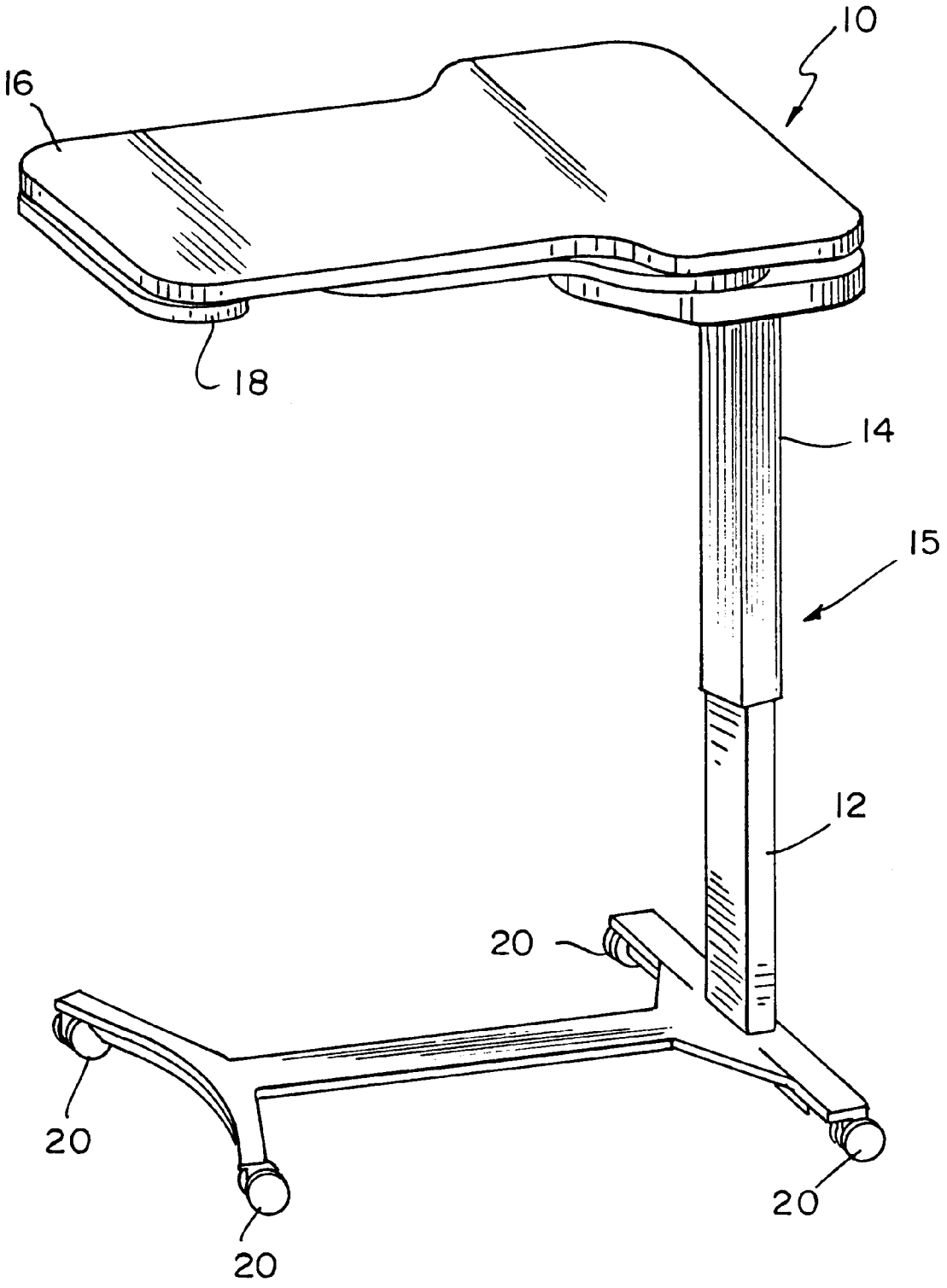
FIG. 1 illustrates a perspective view of a telescoping column incorporated into an overbed table of the general type used in hospitals and other healthcare facilities.

An overbed table 10 includes a base 12, a telescoping support column 14, which when combined with base 12 forms a frame or telescoping support column apparatus 15 to support first and second table sections 16 and 18. First and second table sections 16 and 18 are mounted at an upper end of support column 14. Base 12 is somewhat I-shaped in plan view and is provided at its four corners with casters 20 which permit convenient positioning of overbed table 10. Telescoping support column 14 extends upward from base 12 at an angle of, for example, 0° to 10° or so to vertical so that support column 14 can be positioned between a bed rail (not shown) and a mattress (not shown) positioned to lie on a bed frame (not shown).

Figures 4, 5, 6:
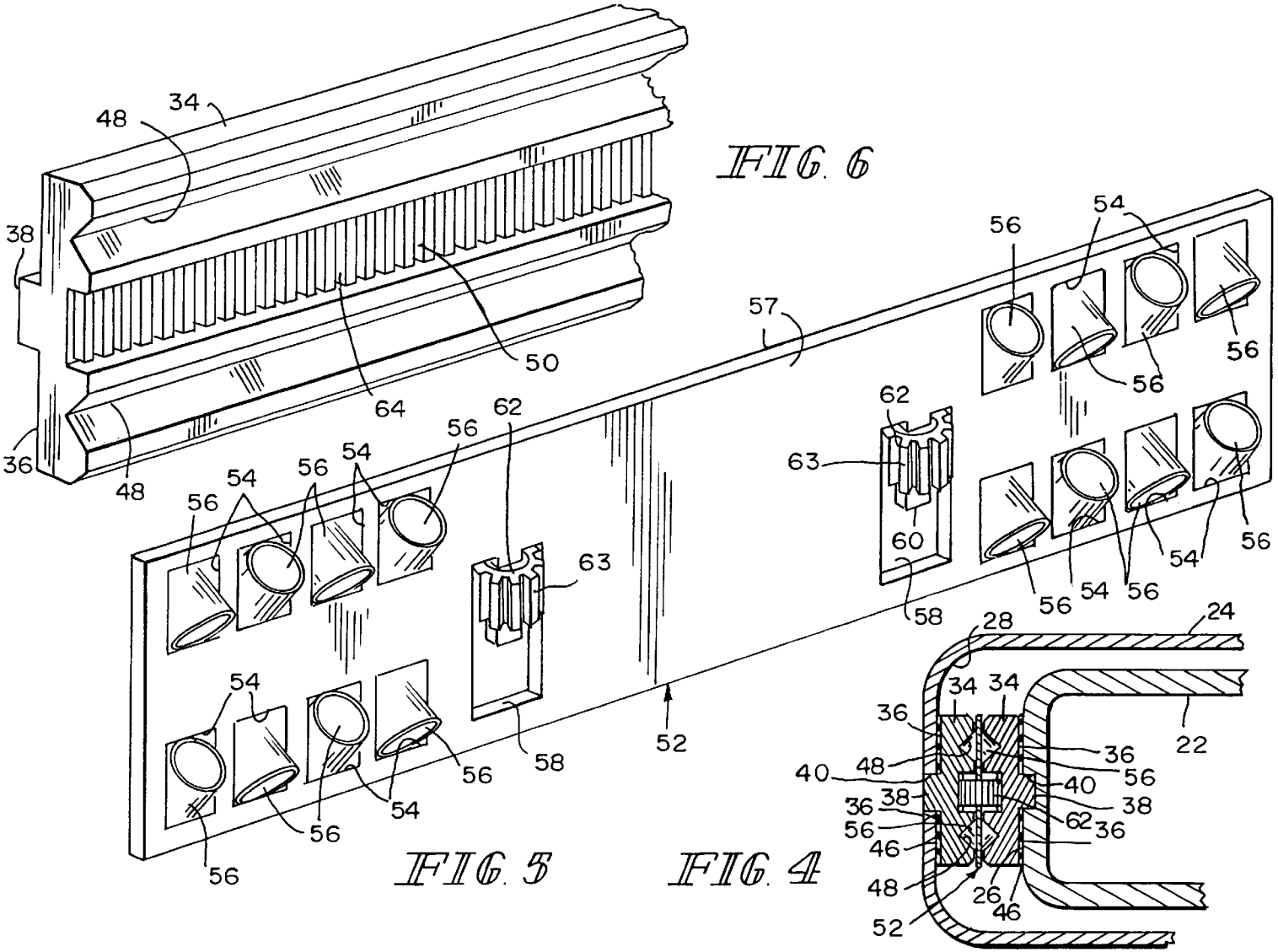
FIG. 4 illustrates a fragmentary sectional view of another telescoping column constructed according to the invention.
FIG. 5 illustrates an enlarged perspective view of a detail of the embodiment illustrated in FIG. 4.
FIG. 6 illustrates an enlarged fragmentary perspective view of another detail of the embodiment illustrated in FIG. 4.

Column 14 includes an inner column portion 22 and an outer column portion 24. Inner and outer column portions 22, 24 include adjacent surfaces 26, 28 and 30, 32, each of which is provided with a rail 34. In one embodiment, illustrated in FIGS. 4 and 6, surface 36 of each rail 34 which lies adjacent a respective surface 26, 28, 30, 32 is provided with a tongue 38 which engages in a groove 40 formed in respective surface 26, 28, 30, 32. In another embodiment, illustrated in FIGS. 2–3, surface 36 of each rail 34 which lies adjacent a respective surface 26, 28, 30, 32 is provided with spaced pairs of cylindrical projections or pins 42 which engage recesses or passages 44 formed in respective surface 26, 28, 30 or 32 to mount rail 34 to respective surface 26, 28, 30 or 32. Of course, other suitable mounting techniques, such as threaded fasteners, rivets, or the like, can be used to secure rails 34 to surfaces 26, 28, 30, 32. In the illustrated embodiments, however, rails 34 "float" adjacent their respective surfaces 26, 28, 30, 32 on elastomeric sheets 46 (FIG. 4) which are disposed between surfaces 36 of rails 34 and respective surfaces 26, 28, 30, 32.

On its side opposite surface 36, each rail 34 includes at least one, and in one illustrative embodiment, two, longitudinally extending, somewhat V-shaped bearing race(s) 48. A rack 50 (FIG. 6) can be provided on each rail 34, for example, between its bearing races 48. A bearing cage 52 includes openings 54 for retaining generally right circular cylindrical bearing rollers 56 in longitudinally spaced-apart relation between facing races 48 of two rails 34. Adjacent rollers 56 are oriented with their axes of rotation angled substantially 90° to each other and substantially 45° to the major surfaces 57 of the cage 52. Openings 58 (FIG. 5) in cage 52 are provided with axles 60 for rotatably supporting pinion gears 62. When a cage 52 with its rollers 56 and gears 62 is assembled between two rails 34, teeth 63 of gears 62 mesh with teeth 64 of racks 50 of both rails 34. This engagement, plus elastomeric sheets 46, where tolerances make such sheets 46 necessary or desirable, snubs or damps the telescoping motion of column portions 22 and 24 with respect to each other.

Illustratively, rails 34 can be constructed from powdered metal, extruded metal, with or without hardened races 48, depending upon the metal, filled or unfilled resin with hardened metallic races 48 comolded into it, for example, by inserting races 48 into one of the mold components and injecting the resin behind the races 48, or the like. Illustratively, rollers 56 are stainless or hardened steel. Illustratively, cages 52 are formed or stamped sheet metal or filled or unfilled resin such as, for example, injection molded resin. Illustratively, gears 62 are constructed from powdered metal, but gears 62 could either be metallic or filled or unfilled resin.

Figure 7:
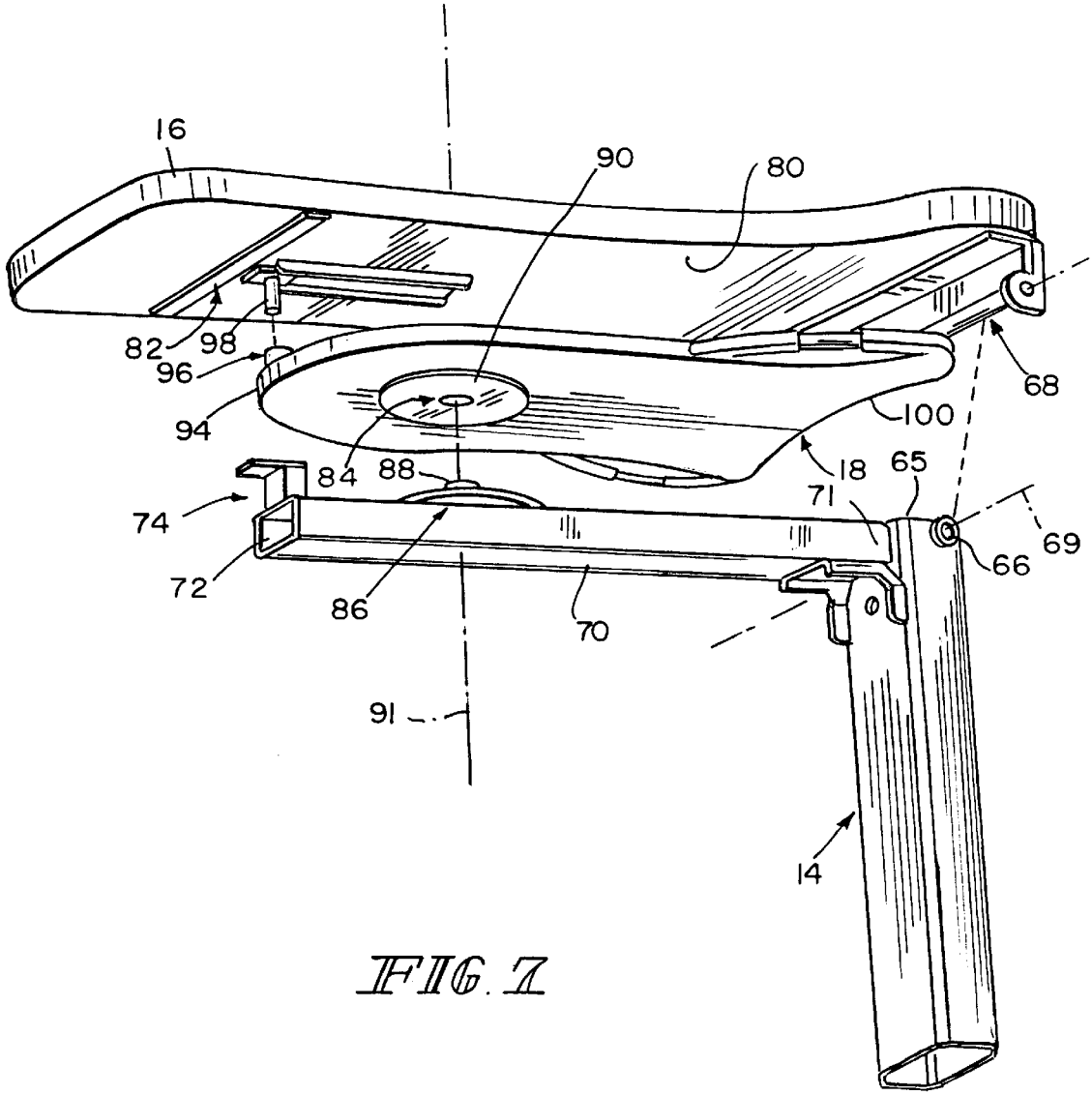
FIG. 7 is an exploded view of first and second table sections of the overbed table of FIG. 1.
Figure 9:
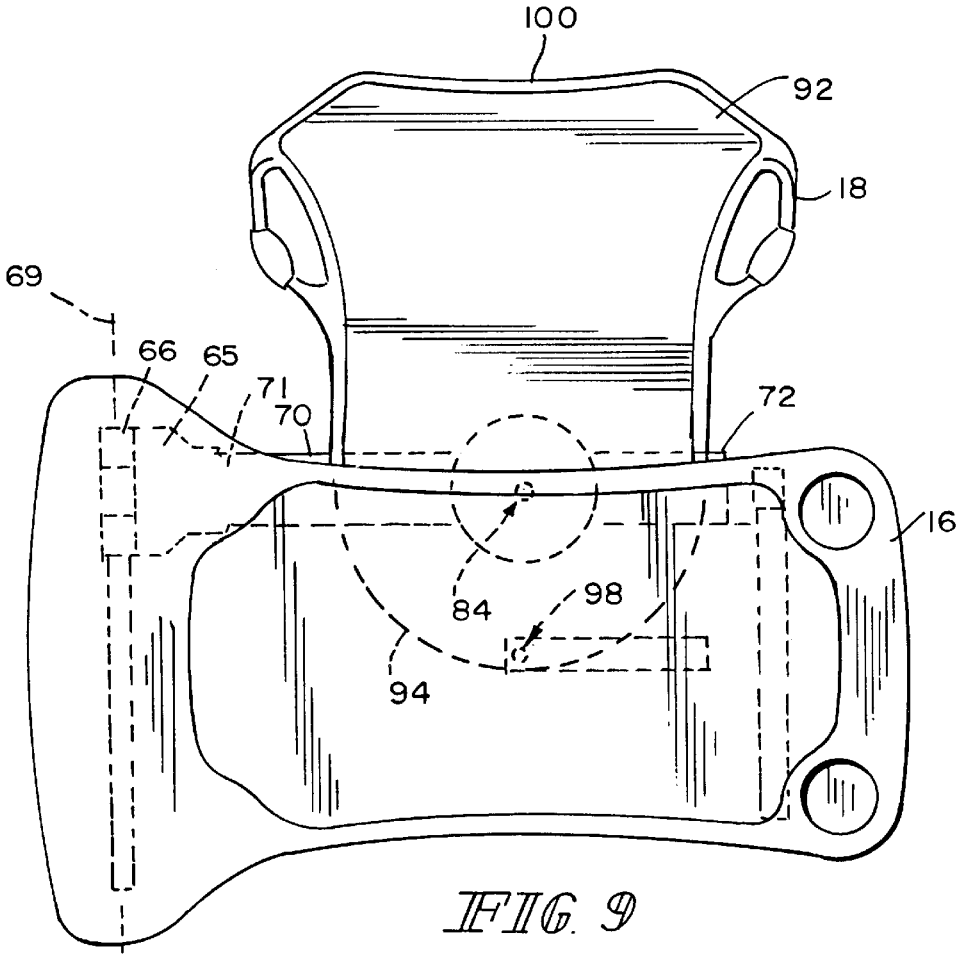
FIG. 9 is a view similar to FIG. 8, but showing the table sections moved in separate directions.
Figure 10:
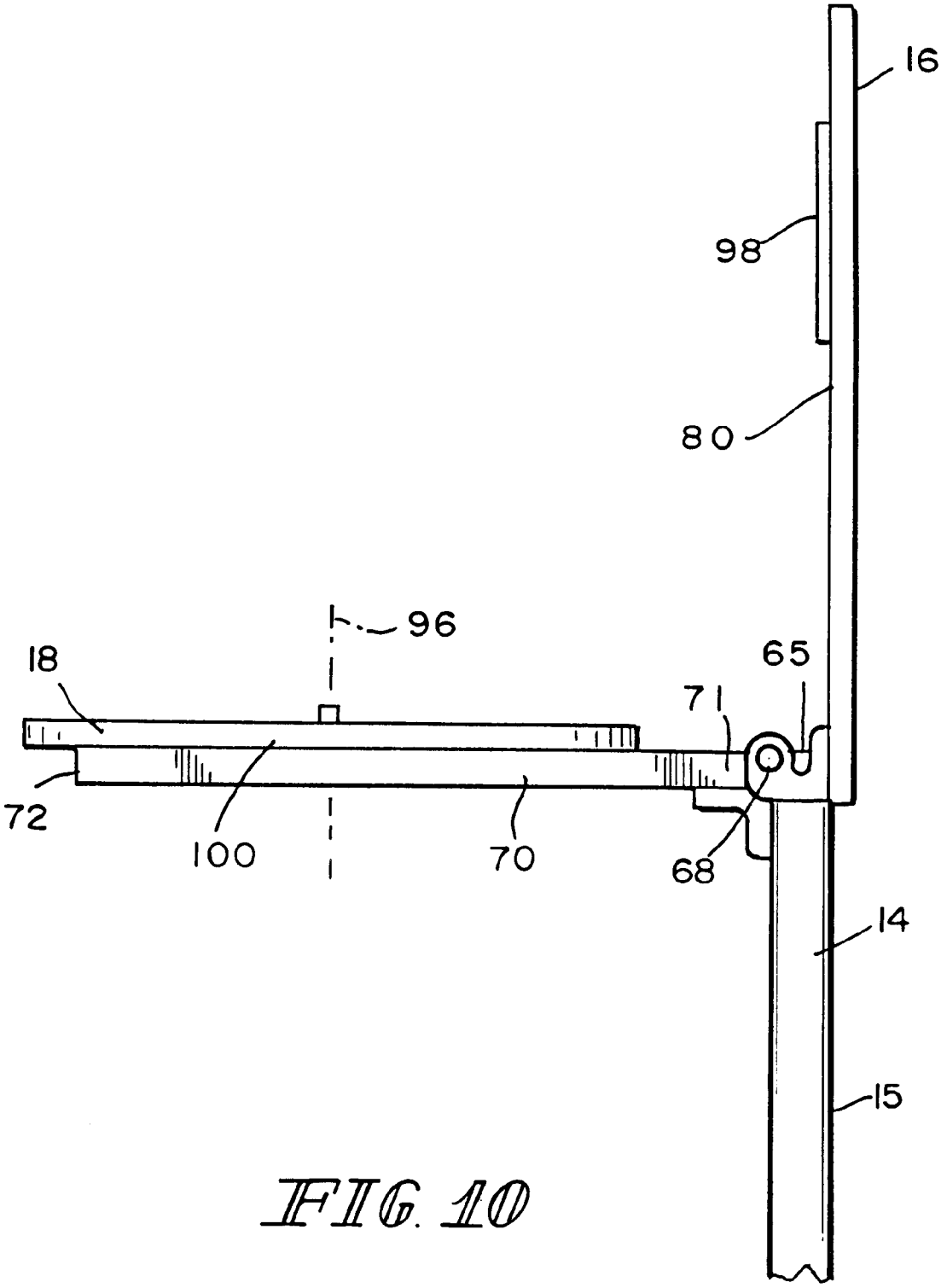
FIG. 10 is a side elevation view of the table sections of FIG. 7, but showing the first table section rotated into a vertical position.

Adjacent its upper extent 65, as illustrated in FIGS. 1 and 9–10, outer column portion 24 is provided with a sleeve 66 which extends horizontally generally between surfaces 28 and 32. First table section 16 includes a rod or tube 68 having substantially the same cross-section transverse to its longitudinal extent as sleeve 66. Rod or tube 68 extends through sleeve 66 and is slidable and rotatable about its longitudinal axis 69 in sleeve 66, as illustrated in FIGS. 9 and 10, to permit first table section 16 to slide linearly away from second table section 18 and to rotate between a generally upright vertical position and a horizontal table position. Adjacent its upper extent 65, outer column portion 24, as illustrated best in FIGS. 7 and 10, is also provided with a beam 70 which forms a portion of frame 15. One end 71 of beam 70 is mounted to outer column portion 24, and an opposite remote end 72 extends from outer column portion 24 in the same direction as base 12. Remote end 72 of beam 70 is provided with a rest 74 which limits the downward pivoting of first table section 16 as sleeve 66 pivots on rod or tube 68. An underside 80 of first table section 16 may include a bearing surface 82 which slides on rest 74 to reduce wear on underside 80 of table section 16.

Second table section 18 includes a bearing 84 which is generally circular in plan view and provides a generally flat bearing surface. Intermediate outer column portion 24 and remote end 72, beam 70 is provided with a complementary bearing surface 86 which is generally flat and circular. One of second table section 18 and beam 70, beam 70 in the illustrated embodiment (FIG. 7), is provided with a pivot post 88, and the other of second table section 18 and beam 70, second table section 18 in the illustrated embodiment, is provided with a recess 90 for receiving pivot post 88. Second table section 18 is releasably mounted and moves pivotally about pivot axis 91 on pivot post 88. On its upwardly facing surface 92 at its end 94 remote from outer column portion 24, second table section 18 is provided with a roller bearing 96. The underside 80 of first table section 16 includes a bearing track 98 for receiving roller bearing 96 when second table section 18 is in its lowered position resting on rest 74. With this linkage, pivotal movement of second table section 18 results in sliding movement of first table section 16 along sleeve 66. Pivotal movement of end 100 of second table section 18 away from outer column portion 24 of frame 15 results in sliding movement of first table section 16 in an opposite direction. Pivotal movement of end 100 of second table section 18 toward outer column portion 24 of frame 15 results in sliding movement of first table section 16 toward second table section 18.

Similarly, sliding movement of first table section 16 away from second table section 18 results in pivotal movement of end 100 of second table section 18 away from outer column portion 24 of frame 15. Sliding movement of first table section 16 toward outer column portion 24 results in pivotal movement of end 100 of second table section 18 toward outer column portion 24 of frame 15 and first table section 16.

Figure 8:
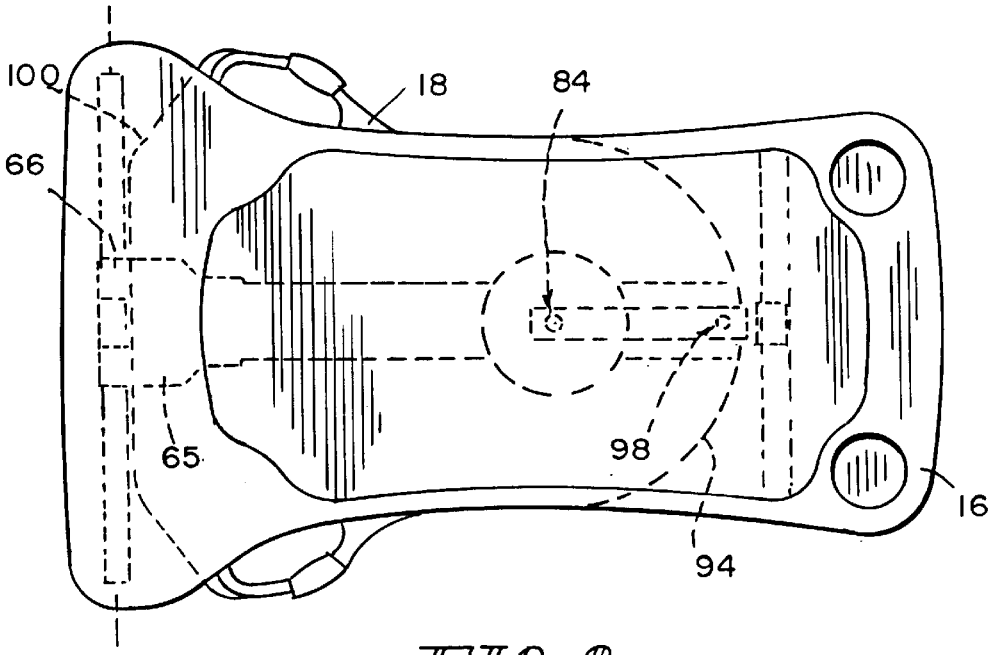
FIG. 8 is a plan view of an upper surface of the table sections of FIG. 7.

Generally, it will be understood that horizontal movement in one plane of one table section 16, 18 results in horizontal movement in an adjacent, substantially parallel plane of the other table section 16, 18. In a storage position, as illustrated in FIG. 8, second table section 18 is positioned below the first table section 16. In the use position, as illustrated best in FIG. 9, the second table section 18 is moved at least partially out from under the first table section 16.

Although the invention has been described in detail with reference to certain preferred embodiments, variations and modifications exist within the scope and spirit of the invention as described and defined in the following claims.

What is claimed is:

1. An overbed table including a table portion and a telescoping support column including an outer column portion and an inner column portion, a table portion coupled to one of the outer and inner column portions, a base coupled to the other of the outer and inner column portions, the inner and outer column portions having bearing surfaces adjacent each other, a bearing cage oriented between the adjacent bearing surfaces of the inner and outer column portions, and bearings captured between the surfaces and the bearing cage, the bearings having bearing surfaces engaging the bearing surfaces to promote projection of the inner column portion from, and retraction of the inner column portion into, the outer column portion.

2. The apparatus of claim 1 wherein the bearing surfaces include bearing races, the bearings captured between the races and within the cage.

3. An overbed table including a table portion and a telescoping support column including an outer column portion and an inner column portion, a table portion coupled to one of the outer and inner column portions, a base coupled to the other of the outer and inner column portions, the inner and outer column portions having surfaces adjacent each other, a bearing cage oriented between the adjacent surfaces of the inner and outer column portions, and bearings captured between the surfaces and the bearing cage, the bearings engaging the surfaces to promote projection of the inner column portion from, and retraction of the inner column portion into, the outer column portion, wherein the surfaces include bearing races, the bearings captured between the races and within the cage, and wherein the bearings include roller bearings having axes of rotation, the axes of rotation of some of the bearings making non-zero angles with respect to the axes of rotation of others of the bearings.

4. An overbed table including a table portion and a telescoping support column including an outer column portion and an inner column portion, a table portion coupled to one of the outer and inner column portions, a base coupled to the other of the outer and inner column portions, the inner and outer column portions having surfaces adjacent each other, a bearing cage oriented between the adjacent surfaces of the inner and outer column portions, and bearings captured between the surfaces and the bearing cage, the bearings engaging the surfaces to promote projection of the inner column portion from, and retraction of the inner column portion into, the outer column portion, wherein each of the inner and outer column portions includes two surfaces adjacent two surfaces of the other of the inner and outer column portions, two bearing cages, one of the bearing cages oriented between each pair of adjacent surfaces.

5. The apparatus of claim 4 wherein the bearings include roller bearings having axes of rotation, the axes of rotation of some of the bearings making non-zero angles with respect to the axes of rotation of others of the bearings.

6. The apparatus of claim 5 wherein adjacent roller bearings are oriented with their axes of rotation at substantially 90 degree angles.

7. The apparatus of claim 1 including a brake for increasing the resistance of the outer and inner column portions to relative motion.

8. The apparatus of claim 7 wherein one of the column portions includes a support surface and a rail movable on the support surface, and the brake includes a sheet of compressible material positioned between the support surface and the rail, the bearings rolling against the rail.

9. The apparatus of claim 1 further including a pinion on one of a bearing surface and the cage and a rack on the other of a bearing surface and the cage, the pinion mounted for rotation, the pinion engaging the rack as the outer and inner column portions move relative to each other.

10. The apparatus of claim 9 wherein each of the bearing surfaces includes a rack, the pinion engaging both racks as the outer and inner column portions move relative to each other.

11. The apparatus of claim 10 wherein each of the bearing surfaces further includes a bearing race, the bearings captured between the races and within the cage.

12. An overbed table including a table portion and a telescoping support column including an outer column portion and an inner column portion, a table portion coupled to one of the outer and inner column portions, a base coupled to the other of the outer and inner column portions, the inner and outer column portions having surfaces adjacent each other, a bearing cage oriented between the adjacent surfaces of the inner and outer column portions, and bearings captured between the surfaces and the bearing cage, the bearings engaging the surfaces to promote projection of the inner column portion from, and retraction of the inner column portion into, the outer column portion, each of the surfaces including a rack, a pinion on the cage for engaging both racks as the outer and inner column portions move relative to each other, each of the surfaces further including a bearing race, the bearings captured between the races and within the cage, the bearings including roller bearings having axes of rotation, the axes of rotation of some of the bearings making non-zero angles with respect to the axes of rotation of others of the bearings.

13. The apparatus of claim 12 wherein each of the inner and outer column portions includes two surfaces adjacent two surfaces of the other of the inner and outer column portions, two bearing cages, one of the bearing cages oriented between each pair of adjacent surfaces.

14. The apparatus of claim 13 wherein each of the surfaces includes two bearing races spaced apart transversely of the directions of relative motion of the inner and outer column portions and a rack oriented between the two spaced apart bearing races.

15. The apparatus of claim 14 including a brake for increasing the resistance of the outer and inner column portions to relative motion.

16. The apparatus of claim 15 wherein the brake includes a sheet of compressible material positioned between each of the surfaces provided on the outer column and the outer column.

17. The apparatus of claim 15 wherein the brake includes a sheet of compressible material positioned between each of the surfaces provided on the inner column and the inner column.

18. The apparatus of claim 1 wherein the telescoping column makes an angle between about 0 degrees to about 10 degrees to a perpendicular to a surface upon which the base rests.

19. An overbed table including a frame, a first table section supported by the frame for movement horizontally with respect to the frame, and a second table section pivotally coupled to the first table section by a first pivotal coupling and to the first table section and frame by a releasable coupling such that movement of the second table section results in sliding movement of the first table section.

20. The apparatus of claim 19 wherein the first table section is further supported by the frame for movement between a generally vertical position and a generally horizontal position.

21. The apparatus of claim 20 wherein the releasable coupling permits movement of the first table section between a generally vertical position and a generally horizontal position independently of the second table section.

22. The apparatus of claim 21 wherein the first table section is supported by the frame by an inner member provided on one of the frame and first table section and an outer member provided on the other of the frame and first table section, the inner member extending rotatably and slidably through the outer member to permit movement sliding and pivoting movement of the first table section with respect to the frame.

23. The apparatus of claim 19 wherein the frame includes a telescoping support column including an outer column portion and an inner column portion, the telescoping support column supporting the first and second table sections, a base coupled to the telescoping support column, the inner and outer column portions having surfaces adjacent each other, a bearing cage oriented between the adjacent surfaces of the inner and outer column portions, and bearings captured between the surfaces and the bearing cage, the bearings engaging the surfaces to promote projection of the inner column portion from, and refraction of the inner column portion into, the outer column portion.

24. The apparatus of claim 23 wherein the surfaces include bearing races, the bearings captured between the races and within the cage.

25. The apparatus of claim 24 wherein the bearings include roller bearings having axes of rotation, the axes of rotation of some of the bearings making non-zero angles with respect to the axes of rotation of others of the bearings.

26. The apparatus of claim 23 wherein each of the inner and outer column portions includes two surfaces adjacent two surfaces of the other of the inner and outer column portions, two bearing cages, one of the bearing cages oriented between each pair of adjacent surfaces.

27. The apparatus of claim 26 wherein the bearings include roller bearings having axes of rotation, the axes of rotation of some of the bearings making non-zero angles with respect to the axes of rotation of others of the bearings.

28. The apparatus of claim 27 wherein adjacent roller bearings are oriented with their axes of rotation at substantially 90 degree angles.

29. The apparatus of claim 23 including a brake for increasing the resistance of the outer and inner column portions to relative motion.

30. The apparatus of claim 29 wherein the brake includes a sheet of compressible material positioned between the surface and the column.

31. The apparatus of claim 23 further including a pinion on one of a surface and the cage and a rack on the other of a surface and the cage, the pinion mounted for rotation, the pinion engaging the rack as the outer and inner column portions move relative to each other.

32. The apparatus of claim 31 wherein each of the surfaces includes a rack, the pinion engaging both racks as the outer and inner column portions move relative to each other.

33. The apparatus of claim 32 wherein each of the surfaces further includes a bearing race, the bearings captured between the races and within the cage.

34. The apparatus of claim 33 wherein the bearings include roller bearings having axes of rotation, the axes of rotation of some of the bearings making non-zero angles with respect to the axes of rotation of others of the bearings.

35. The apparatus of claim 34 wherein each of the inner and outer column portions includes two surfaces adjacent two surfaces of the other of the inner and outer column portions, two bearing cages, one of the bearing cages oriented between each pair of adjacent surfaces.

36. The apparatus of claim 35 wherein each of the surfaces includes two bearing races spaced apart transversely of the directions of relative motion of the inner and outer column portions and a rack oriented between the two spaced apart bearing races.

37. The apparatus of claim 36 including a brake for increasing the resistance of the outer and inner column portions to relative motion.

38. The apparatus of claim 37 wherein the brake includes a sheet of compressible material positioned between each of the surfaces provided on the outer column and the outer column.

39. The apparatus of claim 37 wherein the brake includes a sheet of compressible material positioned between each of the surfaces provided on the inner column and the inner column.

40. The apparatus of claim 23 wherein the telescoping column makes an angle between about 0 degrees to about 10 degrees to a perpendicular to a surface upon which the base rests.

41. The apparatus of claim 19 wherein the first pivotal coupling includes a first bearing provided on one of the first and second table sections and a bearing race provided on the other of the first and second table sections, the first bearing engaging the race to permit pivoting of the second table section about a first axis with respect to the first table section.

42. The apparatus of claim 41 wherein the second table section is coupled to the frame by a second pivotal coupling between the second table section and the frame.

43. The apparatus of claim 42 wherein the second pivotal coupling includes a trunnion provided on one of the frame and second table section and a recess provided on the other of the frame and second table section for receiving the trunnion to permit pivoting of the second table section about a second axis with respect to the first table section, the second axis spaced from the first axis.

44. The apparatus of claim 43 further including a second bearing provided on at least one of the second table section and the frame adjacent at least one of the trunnion and recess.

45. The apparatus of claim 45 wherein the first table section is further supported by the frame for movement between a generally vertical position and a generally horizontal position.

46. The apparatus of claim 45 wherein the second table section is releasably coupled to the first table section and the frame permitting movement of the first table section between a generally vertical position and a generally horizontal position independently of the second table section.

47. The apparatus of claim 46 wherein the first table section is supported by the frame by an inner member provided on one of the frame and first table section and an outer member provided on the other of the frame and first table section, the inner member extending rotatably and slidably through the outer member to permit movement sliding and pivoting movement of the first table section with respect to the frame.

48. The apparatus of claim 19 wherein the frame includes a telescoping support column including an outer column portion and an inner column portion, the telescoping support column supporting the first and second table sections, a base coupled to the telescoping support column, the inner and outer column portions having surfaces adjacent each other, a bearing cage oriented between the adjacent surfaces of the inner and outer column portions, and bearings captured between the surfaces and the bearing cage, the bearings engaging the surfaces to promote projection of the inner column portion from, and retraction of the inner column portion into, the outer column portion.

49. The apparatus of claim 48 wherein the surfaces include bearing races, the bearings captured between the races and within the cage.

50. The apparatus of claim 49 wherein the bearings include roller bearings having axes of rotation, the axes of rotation of some of the bearings making non-zero angles with respect to the axes of rotation of others of the bearings.

51. The apparatus of claim 48 wherein each of the inner and outer column portions includes two surfaces adjacent two surfaces of the other of the inner and outer column portions, two bearing cages, one of the bearing cages oriented between each pair of adjacent surfaces.

52. The apparatus of claim 51 wherein the bearings include roller bearings having axes of rotation, the axes of rotation of some of the bearings making non-zero angles with respect to the axes of rotation of others of the bearings.

53. The apparatus of claim 52 wherein adjacent roller bearings are oriented with their axes of rotation at substantially 90 degree angles.

54. The apparatus of claim 48 including a brake for increasing the resistance of the outer and inner column portions to relative motion.

55. The apparatus of claim 54 wherein the brake includes a sheet of compressible material positioned between the surface and the column.

56. The apparatus of claim 48 further including a pinion on one of a surface and the cage and a rack on the other of a surface and the cage, the pinion mounted for rotation, the pinion engaging the rack as the outer and inner column portions move relative to each other.

57. The apparatus of claim 56 wherein each of the surfaces includes a rack, the pinion engaging both racks as the outer and inner column portions move relative to each other.

58. The apparatus of claim 57 wherein each of the surfaces further includes a bearing race, the bearings captured between the races and within the cage.

59. The apparatus of claim 58 wherein the bearings include roller bearings having axes of rotation, the axes of rotation of some of the bearings making non-zero angles with respect to the axes of rotation of others of the bearings.

60. The apparatus of claim 59 wherein each of the inner and outer column portions includes two surfaces adjacent two surfaces of the other of the inner and outer column portions, two bearing cages, one of the bearing cages oriented between each pair of adjacent surfaces.

61. The apparatus of claim 60 wherein each of the surfaces includes two bearing races spaced apart transversely of the directions of relative motion of the inner and outer column portions and a rack oriented between the two spaced apart bearing races.

62. The apparatus of claim 61 including a brake for increasing the resistance of the outer and inner column portions to relative motion.

63. The apparatus of claim 62 wherein the brake includes a sheet of compressible material positioned between each of the surfaces provided on the outer column and the outer column.

64. The apparatus of claim 62 wherein the brake includes a sheet of compressible material positioned between each of the surfaces provided on the inner column and the inner column.

65. The apparatus of claim 48 wherein the telescoping column makes an angle between about 0 degrees to about 10 degrees to a perpendicular to a surface upon which the base rests.

* * * * *